US006625998B2

(12) United States Patent
Kim et al.

(10) Patent No.: US 6,625,998 B2
(45) Date of Patent: Sep. 30, 2003

(54) DEVICE FOR CONTROLLING COOLING AIR SUPPLY OF REFRIGERATOR

(75) Inventors: Sang Bae Kim, Changwon (KR); Young Seok Choi, Changwon (KR); Byung Gyu Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 71 days.

(21) Appl. No.: 10/041,507

(22) Filed: Jan. 10, 2002

(65) Prior Publication Data

US 2003/0041606 A1 Mar. 6, 2003

(30) Foreign Application Priority Data

Aug. 31, 2001 (KR) ..... 2001-53406
Aug. 31, 2001 (KR) ..... 2001-53408
Aug. 31, 2001 (KR) ..... 2001-53422

(51) Int. Cl.[7] ..... F25D 17/04; F25D 11/02
(52) U.S. Cl. ..... 62/186; 62/415; 62/440
(58) Field of Search ..... 62/186, 131, 408, 62/89, 407, 440, 441, 415

(56) References Cited

U.S. PATENT DOCUMENTS 5,799,496 A * 9/1998 Park et al. ..... 62/89
5,799,500 A * 9/1998 Kang ..... 62/408
5,802,867 A * 9/1998 Kang ..... 62/408
6,044,654 A 4/2000 Igari et al. ..... 62/186

FOREIGN PATENT DOCUMENTS

EP 0715137 A1 5/1996

* cited by examiner

*Primary Examiner*—Melvin Jones
(74) *Attorney, Agent, or Firm*—Fleshner & Kim, LLP

(57) ABSTRACT

In a refrigerator, in order to provide a device for controlling a cooling air supply of a refrigerator which is capable of regularly maintaining a temperature distribution inside a chilling chamber in a short time by intensively discharging cooling air to a part having a relatively high temperature when a temperature of the part inside the chilling chamber rises due to lots of preserved foods, etc., a device for controlling a cooling air supply of a refrigerator includes a cooling air supply path formed at the upper portion of a mullion wall demarcating a chilling chamber and a freezing chamber and supplying cooling air ventilated by a ventilation fan to the chilling chamber, a cooling air guide path diverged from the cooling air supply path and guiding the cooling air to each part of the chilling chamber, a cooling air duct connected to the cooling air guide path and discharging the cooling air to each partition demarcated by shelves of the chilling chamber and a cooling air control means intensively discharging the cooling air to a partition at which a load has occurred of the partitions demarcated by the shelves of the chilling chamber.

17 Claims, 11 Drawing Sheets

DEVICE FOR CONTROLLING COOLING AIR SUPPLY OF REFRIGERATOR

BACKGROUND OF THE INVENTION

1. Field of the Invention

The present invention relates to a device for controlling a cooling air supply of a refrigerator, and in particular to a device for controlling a cooling air supply of a refrigerator which is capable of coping with a load on a chilling chamber and performing an intensive cooling at a part at which the load has occurred by adjusting a quantity of cooling air discharged into the chilling chamber.

2. Description of the Background Art

Generally, a refrigerator is partitioned into a freezing camber for preserving frozen foods and making ice and a chilling chamber preserving cold foods, and a cooling cycle for supplying cooling air to the freezing chamber and the chilling chamber is included.

Presently, a refrigerator can be largely divided into a general type arranging a freezing chamber and a chilling chamber up and down and a side by side type arranging a freezing chamber and a chilling chamber side by side mainly applied to a large refrigerator.

FIG. 1 is a longitudinal sectional view illustrating a cooling air supply device for a side by side type refrigerator in accordance with the prior art, and FIG. 2 is a transverse sectional view illustrating the cooling air supply device for the side by side type refrigerator in accordance with the prior art.

The conventional refrigerator is constructed with a main body 104 having a pair of doors 102 opened/closed at front surface, a freezing chamber 106 placed at one of the right and left sides of the main body 104 and preserving frozen foods, a chilling chamber 108 demarcated by a mullion wall 110, placed at one of the right and left sides of the main frame 104 and preserving cold foods, a ventilation fan 114 installed to the upper portion of the freezing chamber 106 and compulsorily ventilating air cooled by passing an evaporator 112 of a cooling cycle to the freezing chamber 106, and a device for controlling a cooling air supply in order to supply the cooling air ventilated by the ventilation fan 114 to the chilling chamber 108.

A plurality of shelves 114 are installed inside the freezing chamber 106 and the chilling chamber 108 at a certain intervals in order to preserve foods by layers, and vegetable containers 116, 117 for preserving vegetables are placed at the lower portion of the chilling chamber 108.

The device for controlling the cooling air supply includes a cooling air supply path 118 formed at the upper portion of the million wall 110 so as to suck the cooling air ventilated by the ventilation fan 114 installed to the freezing chamber 106 into the chilling chamber 108, and a cooling air discharge duct 120 installed to the upper portion of the chilling chamber 108, connected with the cooling air supply path 118 and discharging the cooling air supplied to the cooling air supply path 118 to the chilling chamber 108.

And, a cooling air suction path 122 sucking the cooling air finished the cooling operation while circulating the chilling chamber 108 into the evaporator 112 of the cooling cycle is formed at the lower portion of the million wall 110.

The cooling air discharge duct 120 is transversely placed at the upper portion of the chilling chamber 108, connected to the cooling air supply path 118 and includes a plurality of cooling air discharge holes 124 formed at the front surface in order to discharge the cooling air to the chilling chamber 108.

In the side by side type refrigerator, when the cooling cycle is operated and the ventilation fan 220 is rotated, the air cooled while passing the evaporator 112 is discharged into the freezing chamber 106 by a ventilation pressure of the ventilation fan 220 and supplied to the chilling chamber 108 through the cooling air supply path 118.

The cooling air supplied to the cooling air supply path 118 is sucked into the cooling air discharge duct 120 and discharged inside the chilling chamber 108 through the plurality of cooling air discharge holes 124 formed at the cooling air discharge duct 120. The cooling air discharged inside the chilling chamber 108 performs the cooling operation of cold foods while circulating the chilling chamber 108, the cooling air finished the cooling operation is sucked into the cooling air cycle through the cooling air suction path 122 formed at the lower portion of the million wall 110 and is cooled again while passing the evaporator 112.

However, in the device for controlling the cooling air supply of the refrigerator in accordance with the prior art, a quantity of cooling air discharged into a chilling chamber through a plurality of cooling air discharge holes is regular, when a temperature inside the chilling chamber rises instantly by an opening/closing of a chilling chamber door or coming in and out of foods, a cooling time for lowering the chilling chamber temperature increases, and it is impossible to coping with a load on the chilling chamber appropriately.

In addition, when the chilling chamber is cooled by cooling air passing the plurality of cooling air discharge holes, because the cooling air is continuously discharged into the chilling chamber after a temperature inside the cooling air reaches an optimum level, an efficiency of a refrigerator is lowered.

In addition, because cooling air is uniformly discharged to a whole chilling chamber although a load has occurred on a certain part of the chilling chamber due to lots of preserved foods, a temperature distribution inside the whole chilling chamber is irregular.

SUMMARY OF THE INVENTION

In order to solve above-mentioned problems, it is an object of the present invention to provide a device for controlling a cooling air supply of a refrigerator which is capable of regularly maintaining a temperature distribution inside a whole chilling chamber in a short time by intensively discharging cooling air to a part when a temperature at the part rises due to lots of preserved foods, etc.

It is another object of the present invention to provide a device for controlling a cooling air supply of a refrigerator which is capable of coping with a temperature rise of a refrigerator actively by supplying lots of cooling air instantly by applying a discharge pressure to cooling air discharged into a chilling chamber when a temperature inside the chilling chamber rises due to lots of preserved foods or opening/closing of a door, etc.

It is still another object of the present invention to provide a device for controlling a cooling air supply of a refrigerator which is capable of improving an efficiency of a refrigerator by supplying cooling air to a freezing chamber by varying a flow path of cooling air supplied to a chilling chamber when a temperature inside the chilling chamber reaches an optimum level.

In order to achieve the above-mentioned objects, a device for controlling a cooling air supply of a refrigerator in accordance with the present invention includes a cooling air supply path formed at the upper portion of a mullion wall demarcating a chilling chamber and a freezing chamber and supplying cooling air ventilated by a ventilation fan to the chilling chamber, a cooling air guide path diverged from the cooling air supply path and guiding the cooling air to each part of the chilling chamber, a cooling air duct connected to the cooling air guide path and discharging the cooling air to each partition demarcated by shelves of the chilling chamber and a cooling air control means intensively discharging the cooling air to a partition at which a load has occurred of the partitions demarcated by the shelves of the chilling chamber.

The cooling control means includes a temperature sensing means respectively installed to each partition demarcated by the selves of the chilling chamber, an opening/closing means respectively formed at each of a plurality of cooling air discharge holes formed at each partition of the chilling chamber and performing an opening/closing operation of each of the plurality of cooling air discharge holes and a control unit operating the opening/closing means selectively according to an electric signal applied from the temperature sensing means.

The temperature sensing means is constructed with a plurality of temperature sensors respectively installed to each partition demarcated by the shelves of the chilling chamber, detecting a temperature of each partition and applying it to the control unit.

The opening/closing means includes a valve plate rotatively installed to each cooling discharge hole and performing an opening/closing operation of the cooling air discharge hole and a stepping motor connected to a rotational axis of the valve plate and rotating the valve plate according to the electric signal applied to the control unit.

The valve plate is formed as a flat plate shape.

A device for controlling a cooling air supply of a refrigerator in accordance with the present invention includes a cooling air supply path formed at the upper portion of a mullion wall demarcating a chilling chamber and a freezing chamber and supplying cooling air ventilated by a ventilation fan to the chilling chamber, a cooling air guide path diverged from the cooling air supply path and guiding the cooling air to each part of the chilling chamber, a cooling air duct connected to the cooling air guide path and discharging the cooling air to each partition diverged by shelves of the chilling chamber and a ventilation means installed to the side of the cooling air supply path, applying a ventilation pressure to the cooling air supplied to the chilling chamber and performing an opening/closing operation of the cooling air supply path.

The ventilation means is constructed as a blower installed to a position at which the cooling air guide path is diverged from the cooling air supply path, closing the cooling air supply path when a temperature inside the chilling chamber reaches a set value and applying a ventilation pressure to the cooling air.

A device for controlling a cooling air supply of a refrigerator includes a cooling air supply path formed at the upper portion of a mullion wall demarcating a chilling chamber and a freezing chamber and supplying cooling air ventilated by a ventilation fan to the chilling chamber, a cooling air guide path diverged from the cooling air supply path and guiding the cooling air to each part of the chilling chamber, a cooling air duct connected to the cooling air guide path and discharging the cooling air to each partition demarcated by shelves of the chilling chamber, a blower installed to the side of the cooling air supply path and applying a ventilation pressure to the cooling air supplied to the chilling chamber and a cooling air control means discharging the cooling air intensively to a partition at which a load has occurred of the partitions demarcated by the shelves of the chilling chamber.

A device for controlling a cooling air supply of a refrigerator in accordance with the present invention includes a cooling air supply path formed at the upper portion of a mullion wall demarcating a chilling chamber and a freezing chamber and supplying cooling air ventilated by a ventilation fan to the chilling chamber, a cooling air guide path diverged from the cooling air supply path and guiding the cooling air to each part of the chilling chamber, a left cooling air duct diverged from the cooling air guide path in the left direction and discharging the cooling air to the left side of the refrigerating chamber, a right cooling air duct diverged from the cooling air guide path in the right direction and discharging the cooling air to the right side of the refrigerating chamber and a cooling air control means selectively discharging the cooling air through the left cooling air duct and the right cooling air duct in accordance with a position at which a load has occurred.

The cooling control means includes a left temperature sensor respectively installed to the left wall surface of the chilling chamber and sensing a temperature at the left side of the chilling chamber, a right temperature sensor installed to the right wall surface of the chilling chamber and sensing a temperature at the right side of the chilling chamber, an opening/closing means selectively connecting a flow path between the cooling air supply path and the left/right cooling air guide ducts and a control unit operating the opening/closing means in accordance with an electric signal applied from the left temperature sensor and the right temperature sensor.

The opening/closing means includes a valve plate rotatively installed at a turning point between the cooling air supply path and the cooling air guide path and a stepping motor connected to the rotational axis of the valve plate and adjusting a rotational angle of the valve plate.

The valve plate rotatively installed to the diverged centrical portion of the cooling air supply path is formed as a disk shape respectively operated as a neutral position regularly supplying a cooling air to the left and the right cooling air guide paths, a left closing position closing the left cooling air guide path and a right closing position closing the right cooling air guide path.

A device for controlling a cooling air supply of a refrigerator in accordance with the present invention includes a cooling chamber formed at the upper portion of a chilling chamber and respectively supplying cooling air to a freezing chamber and the chilling chamber, a cooling air supply path formed at the upper portion of a mullion wall demarcating the freezing chamber and the chilling chamber and supplying the cooling air from the cooling chamber to the chilling chamber, a cooling air duct discharging the cooling air supplied to the cooling air supply path to the chilling chamber and a cooling air control means switching a cooling air flow path in order to supply the cooling air supplied to the chilling chamber to the freezing chamber when a temperature of the chilling chamber reaches a set temperature.

The cooling air control means includes a freezing chamber discharge duct connected between the cooling air supply path and the freezing chamber and discharging the cooling air supplied from the cooling air supply path to the freezing chamber, an opening/closing means installed to the side of the cooling air supply path and closing one of the cooling air supply path and the freezing chamber discharge duct, a temperature sensor installed to the chilling chamber and sensing a temperature of the chilling chamber and a control unit operating the opening/closing means in accordance with an electric signal applied from the temperature sensor.

The freezing chamber discharge duct is formed at the side surface of the freezing chamber, interconnected with the cooling air supply duct and includes a plurality of cooling air discharge holes discharging the cooling air to the freezing chamber.

The opening/closing means includes a valve plate rotatively installed at a turning point between the cooling air supply path and the cooling air guide path and selectively closing one of the cooling air supply path and the cooling air guide path and a stepping motor connected to the rotational axis of the valve plate and rotating the valve plate.

The valve plate is formed as a disk shape facilitative for closing the cooling air supply path and the cooling air guide path.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, devices for controlling a cooling air supply of a refrigerator in accordance with embodiments of the present invention will be described with reference to accompanying drawings.

There can be a plurality of embodiments of device for controlling a cooling air supply of a refrigerator in accordance with the present invention, hereinafter the preferred embodiments will be described.

Figure 1:
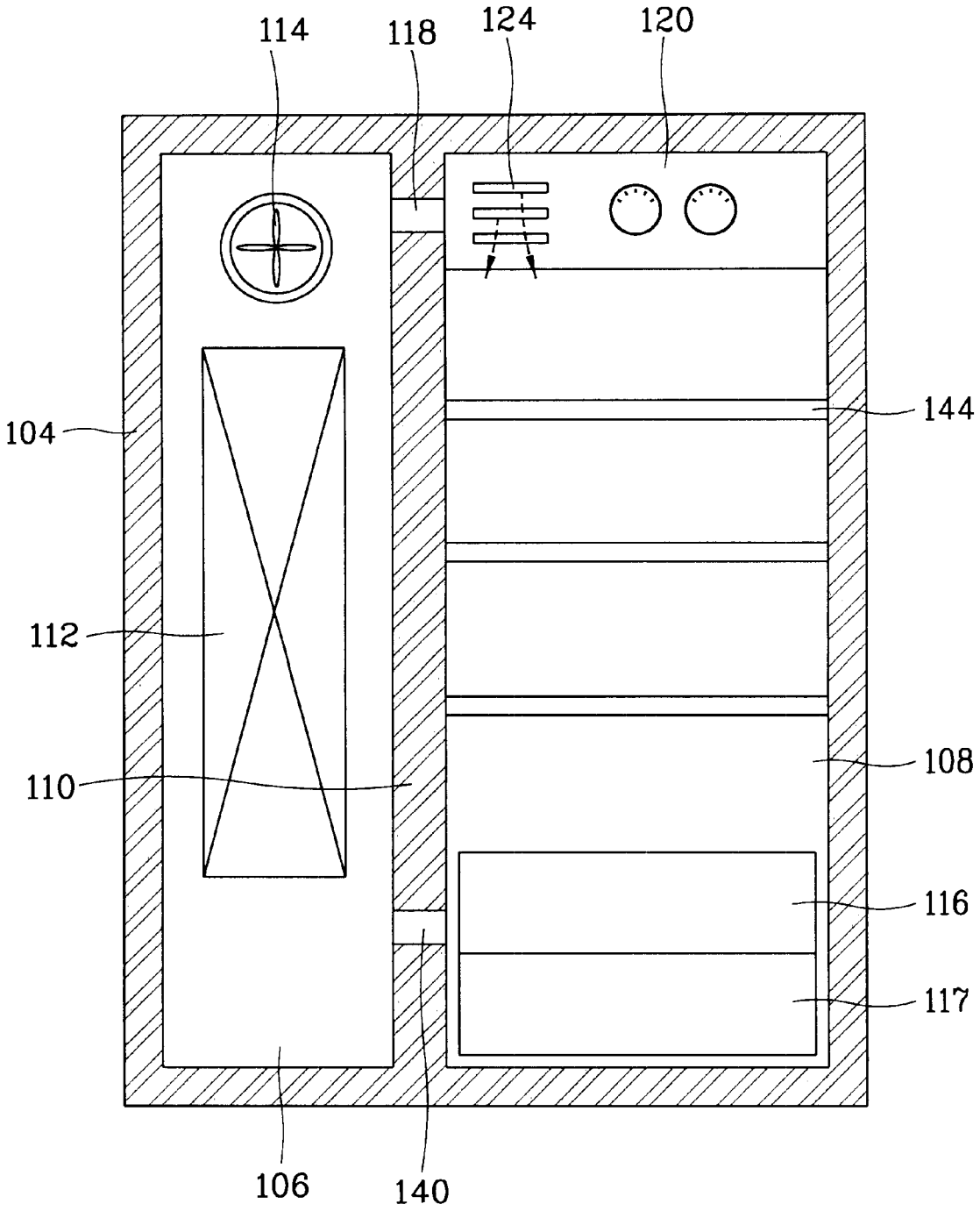
FIG. 1 BACKGROUND ART
FIG. 1 is a longitudinal sectional view illustrating a cooling air supply device for a side by side type refrigerator in accordance with the prior art.
Figure 2:
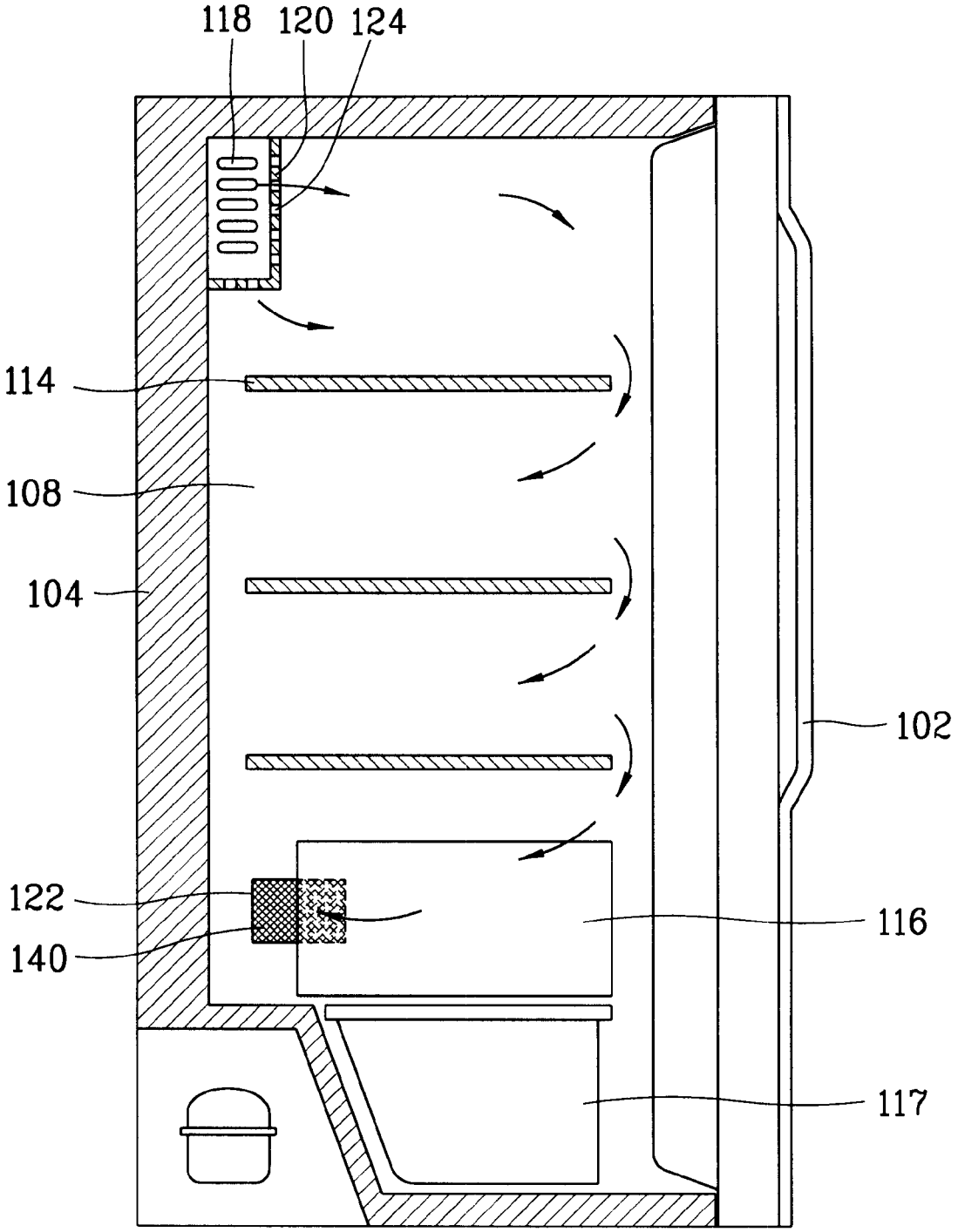
FIG. 2 BACKGROUND ART
FIG. 2 is a transverse sectional view illustrating the cooling air supply device for the side by side type refrigerator in accordance with the prior art.
Figure 3:
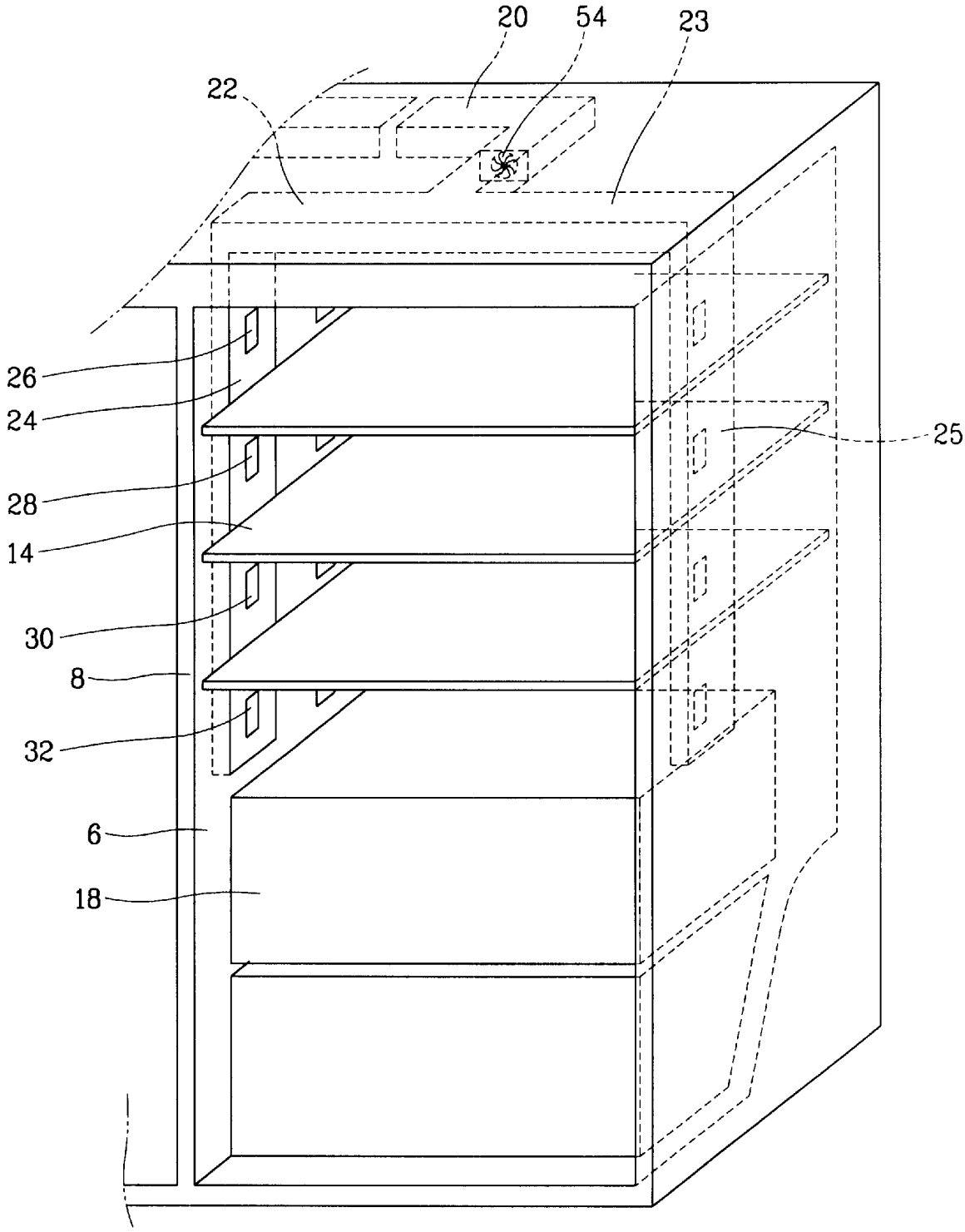
FIG. 3 is a perspective view illustrating a device for controlling a cooling air supply of a refrigerator in accordance with an embodiment of the present invention.
Figure 4:
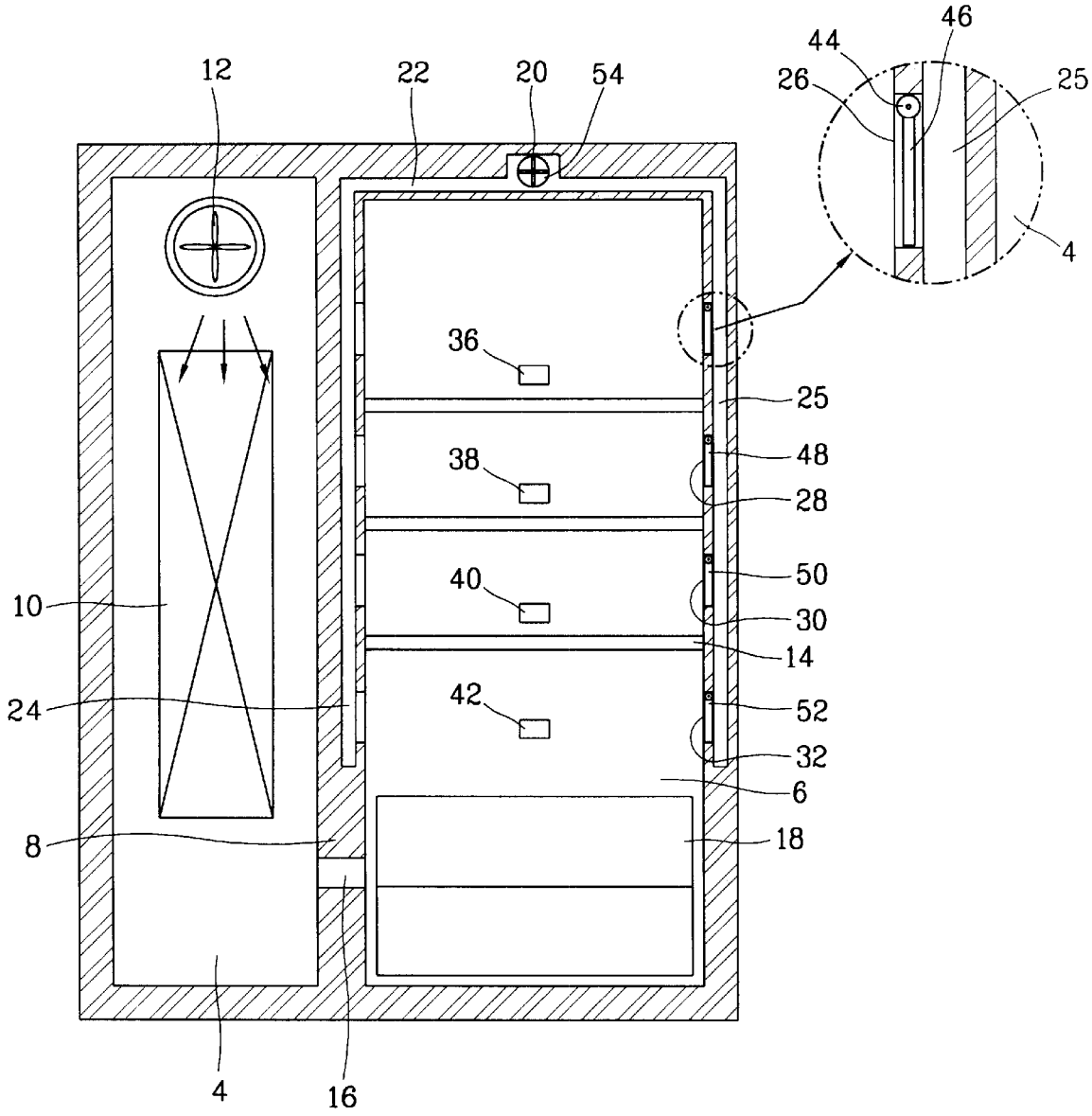
FIG. 4 is a longitudinal sectional view illustrating the device for controlling the cooling air supply of the refrigerator in accordance with the embodiment of the present invention.

FIG. 3 is a perspective view illustrating a device for controlling a cooling air supply of a refrigerator in accordance with an embodiment of the present invention, and FIG. 4 is a longitudinal sectional view illustrating the device for controlling the cooling air supply of the refrigerator in accordance with the embodiment of the present invention;

A refrigerator is constructed with a main body 2 having a door (not shown) installed to the front surface and opened/closed in both directions and a storing space at which foods are preserved, a freezing chamber 4 formed at one of the right and the left sides of the main body 2 and preserving frozen foods, a chilling chamber 6 divided from the freezing chamber 4 by a mullion wall 8 and placed at the side opposite to the freezing chamber 4, a cooling cycle (not shown) installed to the side of the main body 2 and generating cooling air, a ventilation fan 12 supplying cooling air cooled while passing an evaporator 10 of the cooling cycle, a device for controlling a cooling air supply for supplying the air cooled while passing the evaporator 10 to the chilling chamber 6, and a cooling air control means, etc. discharging cooling air to each partition in accordance with a temperature of each partition demarcated by shelves 14 of the chilling chamber 6.

A cooling air inlet path 16 at which the cooling air discharged from the device for controlling the cooling air supply and finished the cooling operation flows into the cooling cycle is formed at the lower portion of the mullion wall 8.

The shelves 14 for mounting foods are installed inside the chilling chamber 6 at a certain intervals, and a vegetable container 18 is placed at the lower portion of the chilling chamber 6.

The device for controlling the cooling air supply of the refrigerator in accordance with an embodiment of the present invention is constructed with a cooling air supply path 20 formed at the upper portion of the mullion wall 8 and supplying a cooling air ventilated by the ventilation fan 12 to the chilling chamber 6, right and left cooling air guide paths 22, 23 diverged from the cooling air supply path 20 and guiding the cooling air to the right and the left sides of the chilling chamber 6, a left cooling air duct 24 connected to the left cooling air guide path 22 and discharging the cooling air to the left side of the chilling chamber 6, and a right cooling air duct 25 connected to the right cooling air guide path 23 and discharging the cooling air to the right side of the chilling chamber 6.

The left and the right cooling air ducts 24, 25 are vertically formed at the left and the right wall surfaces of the chilling chamber 6 so as to have a certain space for passing the cooling air, and a plurality of cooling air discharge holes are formed so as to discharge the cooling air to each partition.

When the chilling chamber 6 is partitioned into four spaces, a first, a second, a third and a fourth cooling air discharge holes 26, 28, 30, 32 are downwardly formed at the four partitions of the chilling chamber 6 as one-to-one correspondence.

Figure 5:
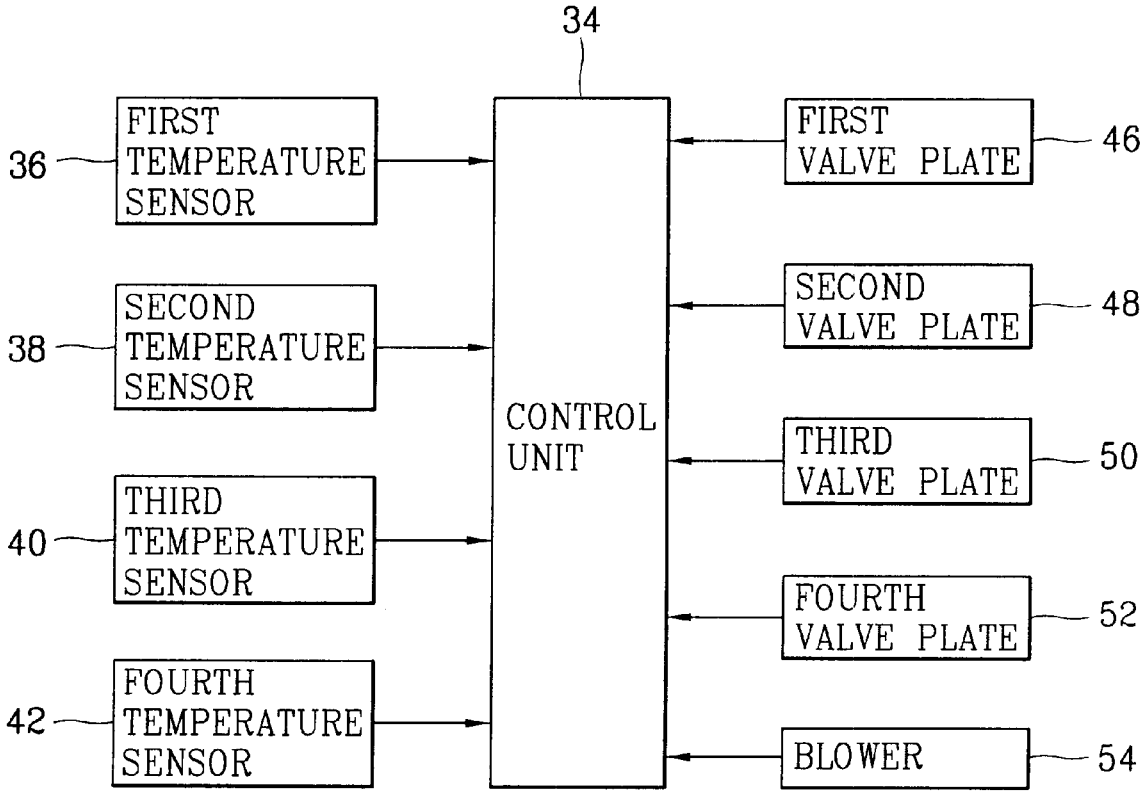
FIG. 5 is a block diagram illustrating the device for controlling the cooling air supply of the refrigerator in accordance with the embodiment of the present invention.

As depicted in FIG. 5, the cooling air control means is constructed with a temperature sensing means respectively installed to each space partitioned by the shelves 14 of the chilling chamber 6, an opening/closing means respectively installed to the cooling air discharge holes 26, 28, 30, 32 and performing an opening/closing operation of the cooling air discharges holes 26, 28, 30, 32, and control unit 34 operating the opening/closing means by an electric signal applied from the temperature sensing means.

The temperature sensing means is a temperature sensor installed to each partition of the chilling chamber 6 and detecting a temperature of each partition, a first, a second, a third and a fourth temperature sensors 36, 38, 40, 42 are downwardly installed to partitions of the chilling chamber 6 as one-to-one correspondence.

Any sensor sensible a temperature inside the chilling chamber 6 and appliable an electric signal to the control unit 34 can be used as the first, second, third and fourth temperature sensors 36, 38, 40, 42.

The opening/closing means includes each valve plate 46, 48, 50, 52 formed as a flat plate shape, rotatively installed to each cooling air discharge hole 26, 28, 30, 32 and adjusting an opening of each cooling air discharge hole, and a stepping motor 44 connected to a hinge shaft of each valve plate and rotating each valve plate.

Herein, the first valve plate 46 is installed to the first cooling air discharge hole 26, the second valve late 48 is installed to the second cooling air discharge hole 28, the third valve plate 50 is installed to the third cooling air discharge hole 30, and the fourth valve plate 52 is installed to the fourth cooling air discharge hole 32.

And, the stepping motor 44 is additionally installed to each valve plate and adjusts the opening of each cooling air discharge hole by rotating each valve plate in accordance with an electric signal applied form the control unit 34.

A ventilation means is installed to the side of the cooling air supply path 20 in order to lower a temperature inside the chilling chamber 6 in a short time by applying a certain ventilation pressure to the cooling air when a temperature inside the chilling chamber 6 rises temporarily.

In more detail, the ventilation means is a blower 54 installed to a portion at which the cooling air guide path 22 is diverged from the cooling air supply path 20, the blower 54 applies a ventilation pressure to the cooling air discharged to the chilling chamber 6 while rotating in accordance with an electric signal applied from the control unit 34 in order to discharge lots of cooling air for a unit time.

The blower 54 applies the ventilation pressure to the cooling air and performs the opening/closing operation of the cooling air supply path 20. In more detail, if the blower 54 is formed as a type having a dense rotational wing, when the blower 54 is not rotated, it can cut off a flow of cooling air into the chilling chamber 6 by closing the cooling air supply path 20.

The operation of the device for controlling the cooling air supply of the refrigerator in accordance with the embodiment of the present invention will be described in more detail.

When the refrigerator is operated, air cooled while passing the cooling cycle is discharged into the freezing chamber 4 by the rotation of the ventilation fan 12 and transferred to the cooling air supply path 20.

The cooling air transferred to the cooling air supply path 20 is respectively guided into the left cooling air duct 24 and the right cooling air duct 25 by the cooling air guide path 22, discharged into the chilling chamber 6 through the plurality of cooling air discharge holes 26, 28, 30, 32, performs the cooling operation while circulating the chilling chamber 6, and the cooling air finished the cooling operation is transferred again to the cooling cycle through the cooling air inlet path 16.

During the cooling operation, each of the first, the second, the third and the fourth temperature sensors 36, 38, 40, 42 senses a temperature of each partition partitioned by the shelves 14, applies an electric signal in accordance with the temperature to the control unit 34, and the control unit 34 selectively opens/closes the first~the fourth valve plates 46, 48, 50, 52 and adjusts the opening in accordance with the electric signals applied from the plurality of temperature sensors 36, 38, 40, 42.

In more detail, when a temperature at the upper portion of the chilling chamber 6 rises due to lots of preserved foods, the first temperature sensor 36 senses the temperature rise and applies an electric signal according to the temperature to the control unit 34.

Then, the control unit 34 operates the first valve plate 46 in a direction at which the first cooling air discharge hole 26 is opened, the second, the third and the fourth valve plates 48, 50, 52 are operated in a direction at which the second, the third and the fourth cooling air discharge holes 28, 30, 32 are closed, the cooling air is intensively discharged into the upper portion of the chilling chamber 6, accordingly the temperature at the upper portion of the chilling chamber 6 is instantly lowered.

And, the control unit 34 adjusts a quantity of cooling air discharged into the chilling chamber 6 by adjusting a rotational angle of the first~the fourth valve plates 46, 48, 50, 52 in accordance with the electric signal applied form the first~the fourth temperature sensors 36, 38, 40, 42.

As described above, when a load has occurred at a certain portion of the chilling chamber 6, the cooling air discharge hole placed at the portion at which the load has occurred is opened in order to discharge cooling air intensively, and the rest of the cooling air discharge holes are closed. And, a quantity of discharged cooling air can be adjusted by adjusting an opening degree of each valve plate in accordance with a temperature of the chilling chamber 6.

Herein, if the blower 54 is installed to the cooling air supply path 20, when a temperature inside the chilling chamber 6 rises, the control unit 34 applies a ventilation pressure to the cooling air discharged into the chilling chamber 6 by operating the blower 54 in order to discharge more cooling air in a short time, accordingly a temperature inside the chilling chamber 6 can be maintained as low.

And, the blower 54 performs the opening/closing operation of the cooling air discharged into the chilling chamber 6. In more detail, by constructing the rotational wing of the blower 54 closely, when the blower 54 is stopped, it can cut off the cooling air supply by closing the cooling air supply path 20, when the blower 54 is rotated, the cooling air is discharged into the chilling chamber 6.

Figure 6:
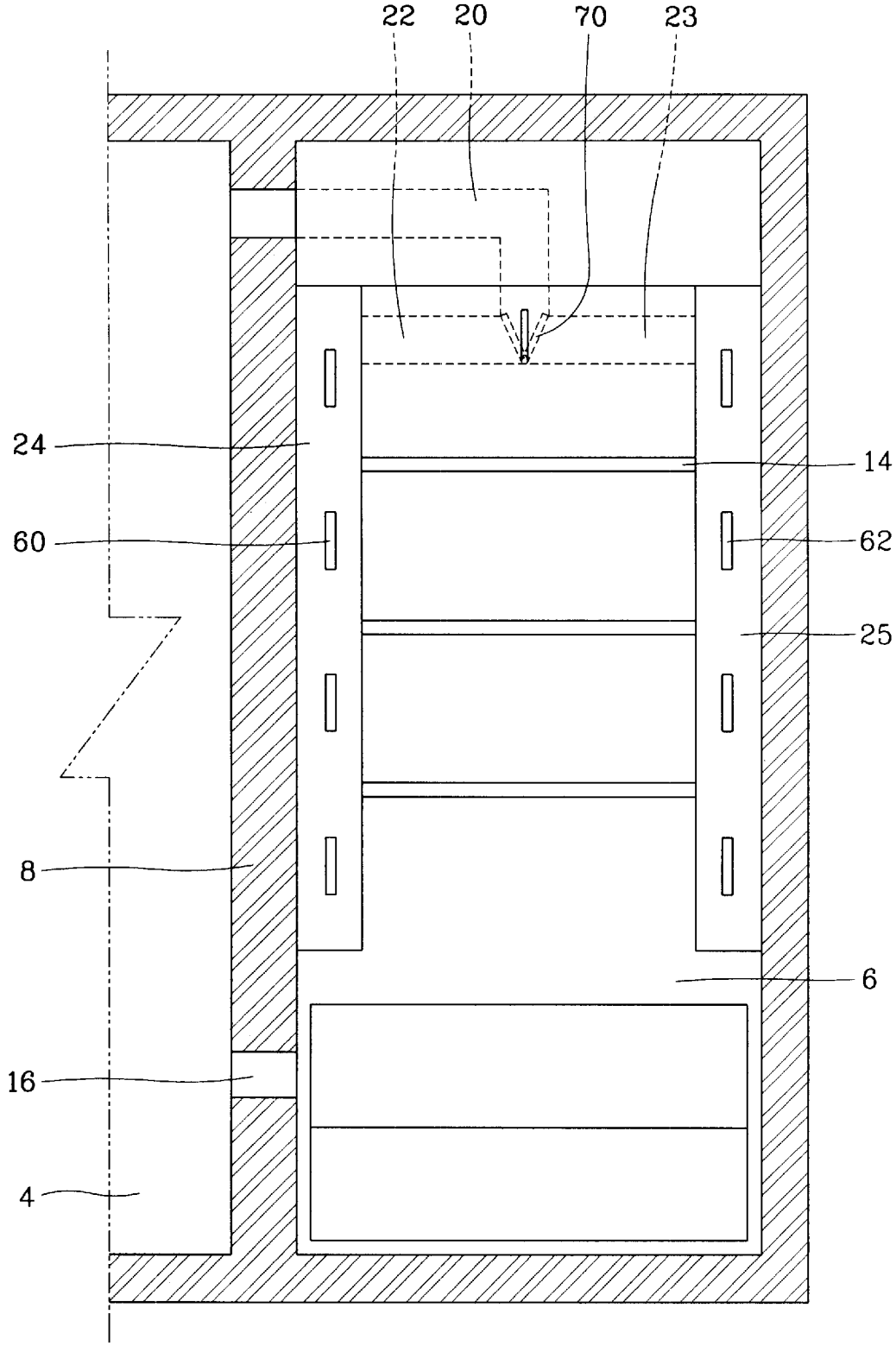
FIG. 6 is a sectional view illustrating a device for controlling a cooling air supply of a refrigerator in accordance with a second embodiment of the present invention.
Figure 7:
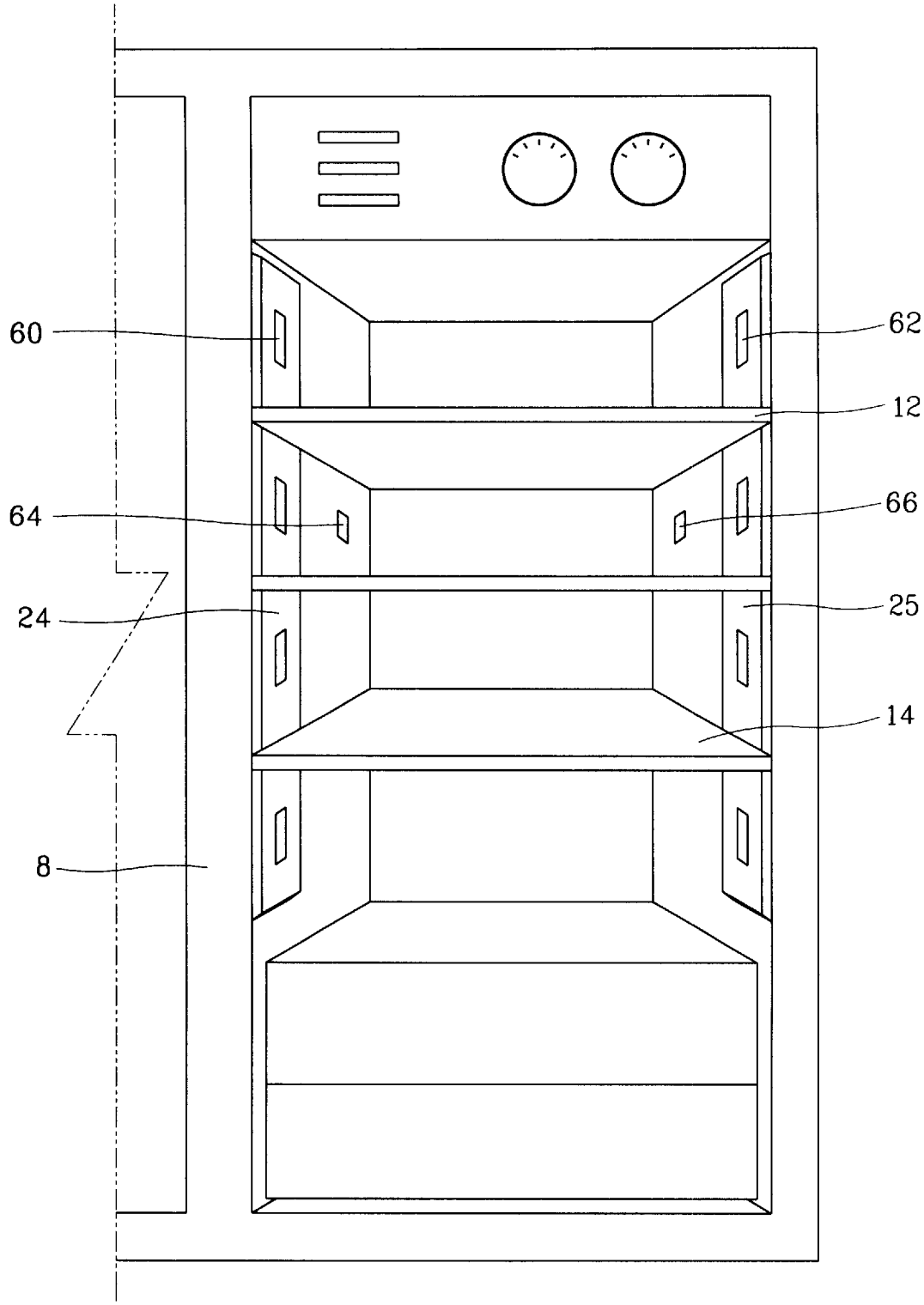
FIG. 7 is a front view illustrating the refrigerator in accordance with the second embodiment of the present invention.

FIG. 6 is a sectional view illustrating a device for controlling a cooling air supply of a refrigerator in accordance with a second embodiment of the present invention, and FIG. 7 is a front view illustrating the refrigerator in accordance with the second embodiment of the present invention.

A device for controlling a cooling air supply of a refrigerator in accordance with a second embodiment of the present invention includes a cooling air supply path 20 formed at the upper portion of a mullion wall 8 demarcating a chilling chamber 6 and a freezing chamber 4, connected to the upper portion of the chilling chamber 6 and supplying cooling air to the chilling chamber 6, a left and a right cooling air guide paths 22, 23 diverged from the cooling air supply path 20 and respectively guiding cooling air to the left and the right sides of the chilling chamber 6, a left cooling air duct 24 connected to the left cooling air guide path 22 and discharging cooling air to the left side of the chilling chamber 6, a right cooling air duct 25 connected to the right cooling air guide path 23 and discharging cooling air to the right side of the chilling chamber 6, and a cooling air control means controlling the left cooling air duct 24 and the right cooling air duct 25 so as to discharge the cooling air selectively in accordance with a portion at which a load has occurred of the chilling chamber 6.

The left cooling air duct 24 is interconnected with the left cooling air guide path 22, has a certain vertical space for passing the cooling air at the left wall and has a plurality of cooling air discharge holes 60 so as to discharge the cooling air to each partition partitioned by the shelves 14.

The right cooling air duct 25 vertically formed at the right wall of the chilling chamber 6 is interconnected with the right cooling air guide path 23, and a plurality of cooling air discharge holes 62 are formed at the front surface of the right cooling air duct 25 at regular intervals.

Figure 8:
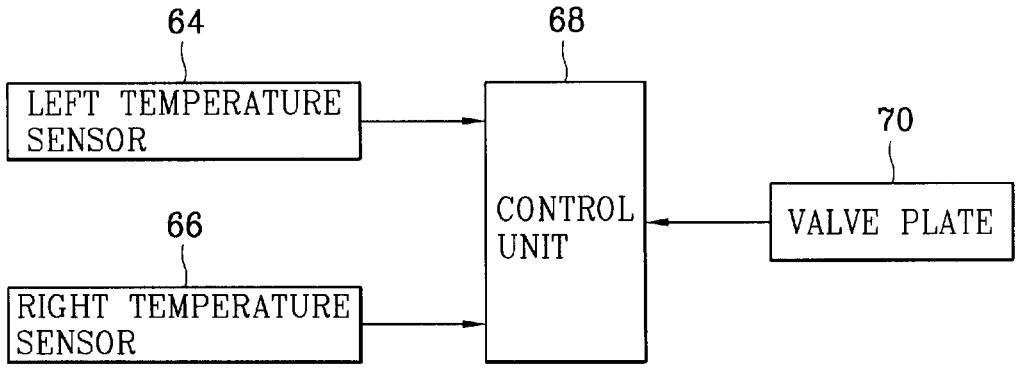
FIG. 8 is a block diagram illustrating the device for controlling the cooling air supply of the refrigerator in accordance with the second embodiment of the present invention.

As depicted in FIG. 8, the cooling air control means is constructed with a left temperature sensor 64 installed to the left wall surface of the chilling chamber 6 and sensing a temperature at the left side of the chilling chamber 6, a right temperature sensor 66 installed to the right wall surface of the chilling chamber 6 and sensing a temperature at the right side of the chilling chamber 6, an opening/closing means installed on the cooling air supply path 20 and selectively opening/closing the left and right cooling air guide paths 22, 23, and a control unit 68 operating the opening/closing means in accordance with an electric signal applied from the left and the right temperature sensors 64, 66.

Herein, any sensor sensible a temperature inside the chilling chamber 6 and appliable an electric signal to the control unit 68 can be used as the left and the right temperature sensors 64, 66.

The opening/closing means is constructed with a valve plate 70 rotatively installed to a turning point between the cooling air supply path 20 and the left and the right cooling air guide paths 22, 23, and a stepping motor 72 connected to the rotational axis of the valve plate 70 and adjusting a rotational angle of the valve plate 70.

Figure 9:
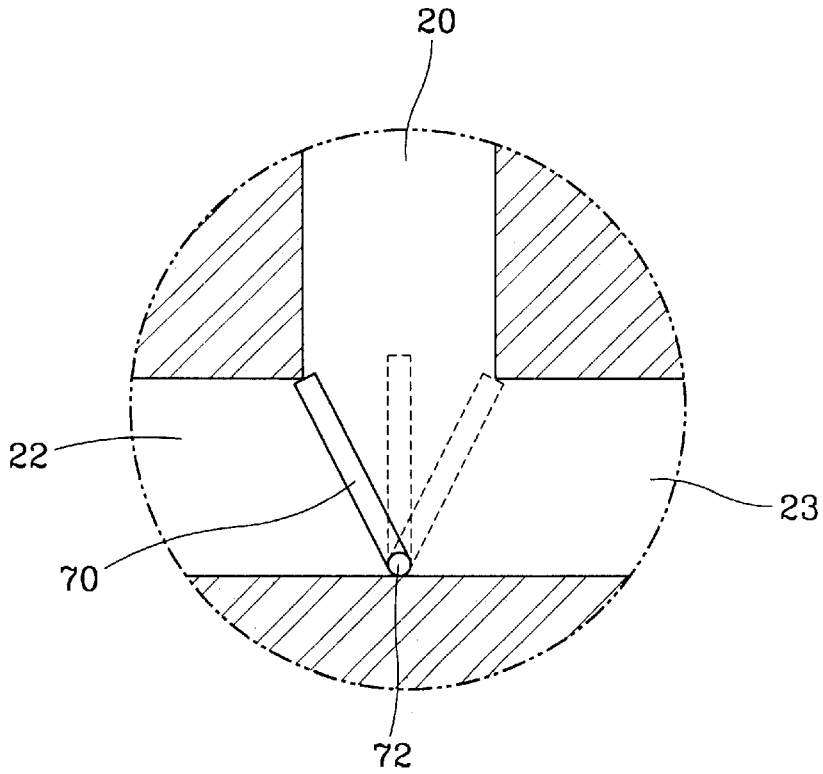
FIG. 9 is a partial sectional view illustrating an operation state of a valve plate of the device for controlling the cooling air supply of the refrigerator in accordance with the second embodiment of the present invention.

As depicted in FIG. 9, the valve plate 70 formed as a disk shape having a certain diameter is a valve rotatively installed to the diverged centrical portion of the cooling air supply path 20 and switched in three-way.

In more detail, when the valve plate 70 is operated as a neutral position at which it is placed at the center of the cooling air supply path 20, the cooling air supplied from the cooling air supply path 20 is regularly distributed to the left and the right cooling air guide paths 22, 23. And, as depicted in FIG. 9, when the valve plate 70 is slanted to the left, it cuts off the left guide path 22 and opens the right guide path 23, accordingly the cooling air flows from the cooling air supply path 20 into the right guide path 23. And, on the contrary, as depicted in FIG. 9, when the valve plate 70 is slanted to the right, it cuts off the right guide path 23, accordingly the cooling air flows from the cooling air supply path 20 to the left guide path 22.

The operation of the device for controlling the cooling air supply of the refrigerator in accordance with the second embodiment of the present invention will be described in more detail.

When each electric signal from the left temperature sensor 64 and the right temperature sensor 66 is applied to the control unit 68, the control unit 68 judges whether the electric signal applied from the left temperature sensor 64 is same with the electric signal applied from the right temperature sensor 66, when it is judged they are same, the control unit 68 operates the valve plate 70 as the neutral position. Then, the cooling air is regularly distributed from the cooling air supply duct 20 to the left and the right guide paths 22, 23, and the cooling air is simultaneously discharged through the cooling air discharge hole 60 of the left cooling air duct 24 and the cooling air discharge hole 62 of the right cooling air duct 25.

In addition, if load has occurred on the left side of the chilling chamber 6, the control unit 68 compares electric signals applied from the left and the right temperature sensors 64, 66, when it is judged the temperature on the left side of the chilling chamber 6 is higher than the temperature of the right side of the chilling chamber 6, the control unit 68 cuts off the right guide path 23 by rotating the valve plate 70 in the right direction. Then, the cooling air supplied to the cooling air supply path 20 flows into the left cooling air duct 24 through the left guide path 22 and discharged to the left side of the refrigerator.

And, on the contrary, load has occurred on the right side of the chilling chamber 6, the control unit 68 cuts off the left guide path 22 by rotating the valve plate 70 in the left direction. Then, the cooling air flows into the right cooling air duct 25 through the right guide path 23 and discharged to the right side of the refrigerator.

As described above, in the device for controlling the cooling air supply of the refrigerator in accordance with the second embodiment of the present invention, it is possible to perform the instant cooling operation by selectively discharging the cooling air from the left cooling air duct 24 and the right cooling air duct 25 when a temperature inside the chilling chamber 6 rises due to a load on the left or the right side of the chilling chamber 6.

Figure 10:
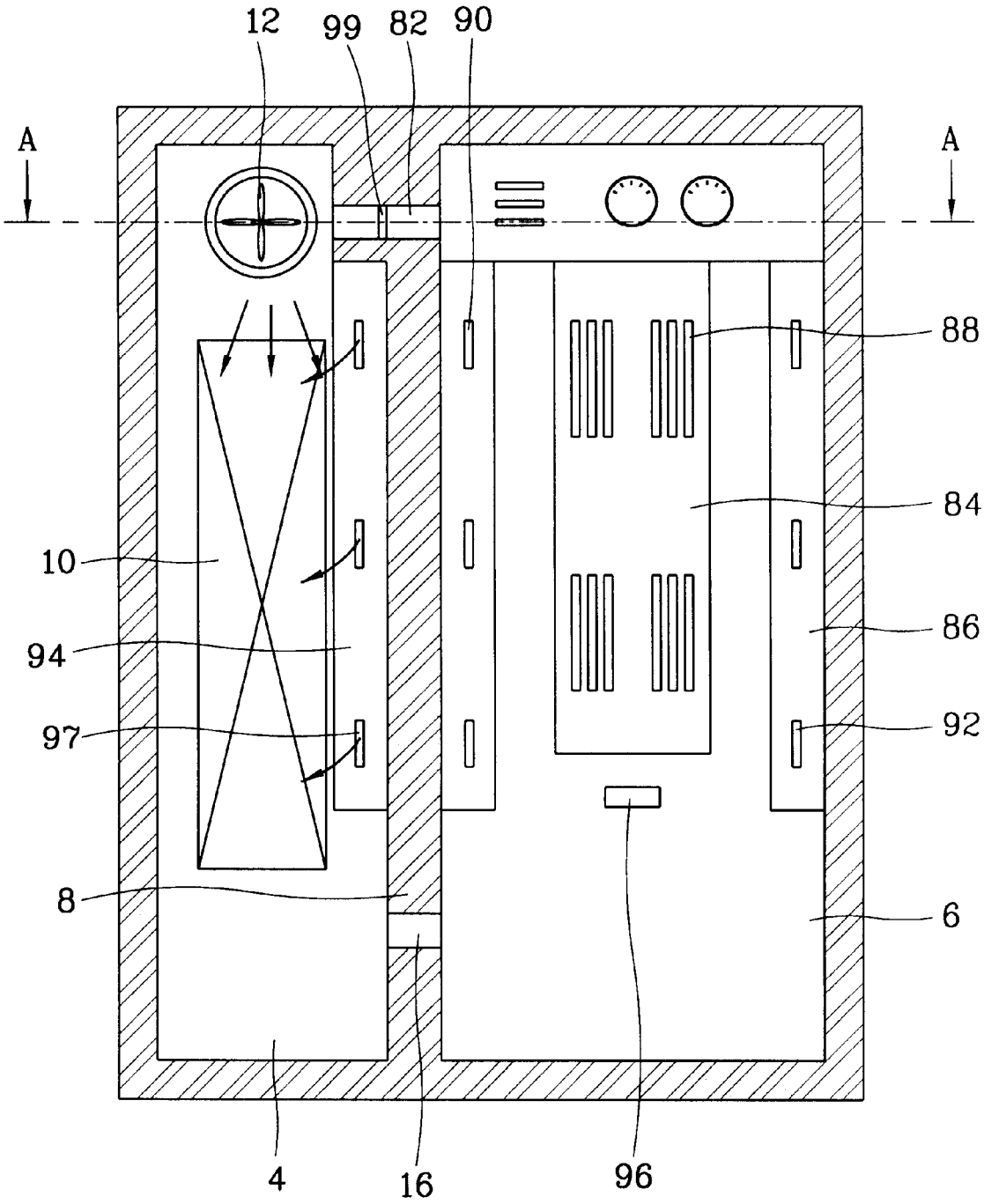
FIG. 10 is a sectional view illustrating a device for controlling a cooling air supply of a refrigerator in accordance with a third embodiment of the present invention.
Figure 11:
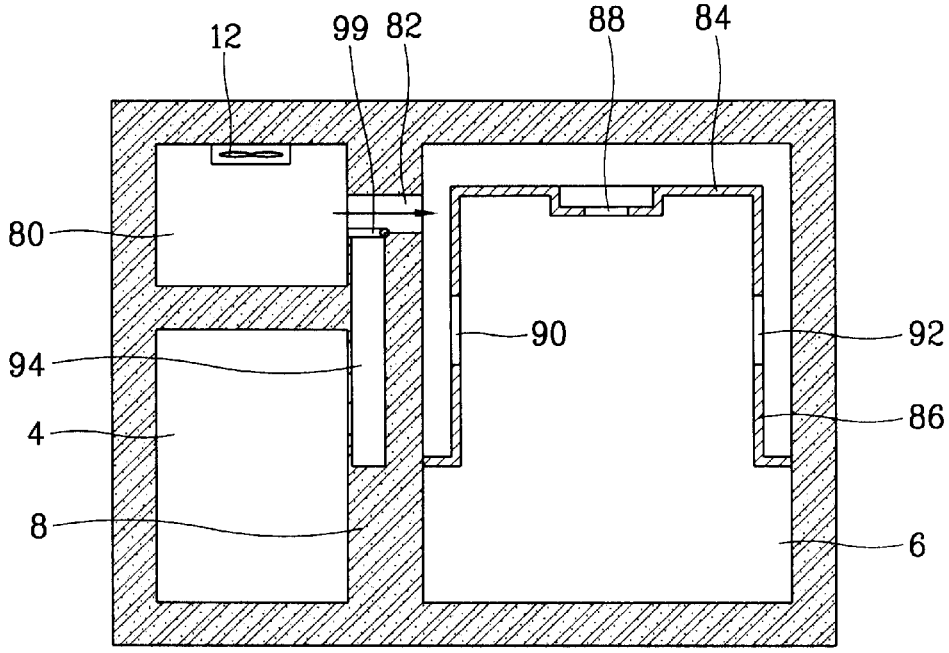
FIG. 11 is a sectional view illustrating the device for controlling the cooling air supply of the refrigerator in accordance with the third embodiment of the present invention taken along the line A—A of FIG. 10.
Figure 12:
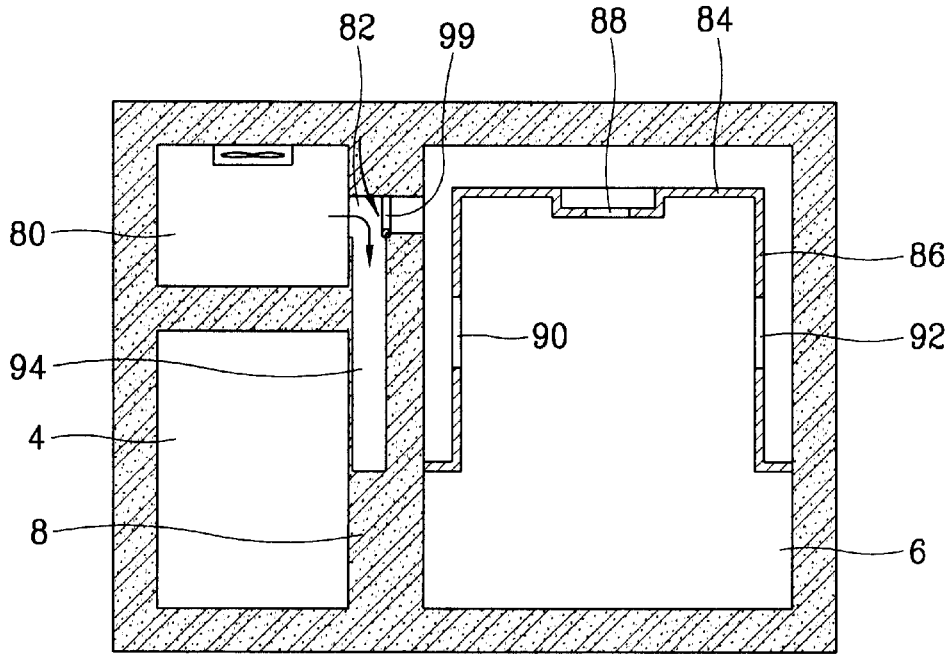
FIG. 12 is a sectional view an operation state of the device for controlling the cooling air supply of the refrigerator in accordance with the third embodiment of the present invention taken along the line A—A of FIG. 10.

FIG. 10 is a sectional view illustrating a device for controlling cooling air supply of a refrigerator in accordance with a third embodiment of the present invention, and FIGS. 11 and 12 are sectional views illustrating the device for controlling the cooling air supply of the refrigerator in accordance with the third embodiment of the present invention taken along the line A—A of FIG. 10.

A device for controlling a cooling air supply of a refrigerator in accordance with a third embodiment of the present invention includes a cooling chamber 80 formed at the upper portion of the chilling chamber 6 and respectively supplying a cooling air to the freezing chamber 4 and the chilling chamber 6, a cooling air supply path 82 formed at the upper portion of the mullion wall 8 demarcating the freezing chamber 4 and the chilling chamber 6 and supplying a cooling air from the cooling chamber 80 to the chilling chamber 6, cooling air ducts 84, 86 respectively discharging the cooling air supplied from the cooling air supply path 82 to the left, the right and the rear surfaces of the chilling chamber 6, and a cooling air control means switching a cooling air flow path in order to supply the cooling air supplied to the chilling chamber 6 to the freezing chamber 4 when a temperature of the chilling chamber 6 reaches a set temperature.

The cooling air ducts 84, 86 respectively include a rear discharge hole 88 discharging the cooling air at the rear of the chilling chamber 6, a left discharge hole 90 discharging the cooling air at the left side of the chilling chamber 6 and a right discharge hole 92 discharging the cooling air at the right side of the chilling chamber 6.

Figure 13:
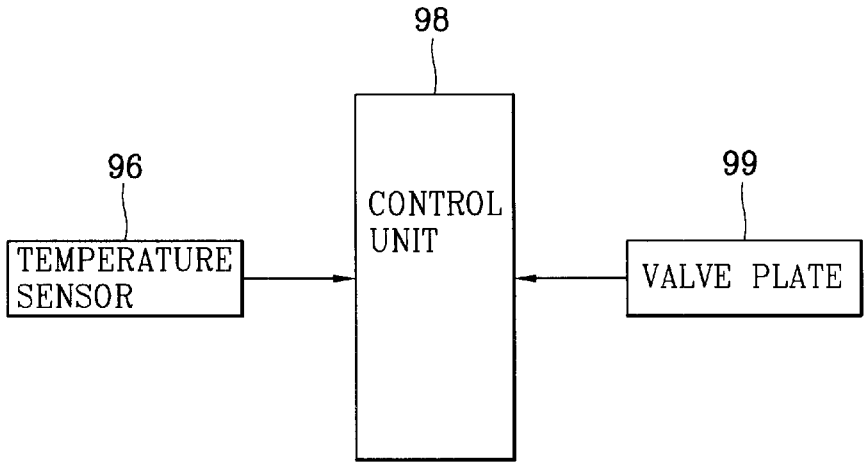
FIG. 13 is a block diagram illustrating the device for controlling the cooling air supply of the refrigerator in accordance with the third embodiment of the present invention.
Figure 14:
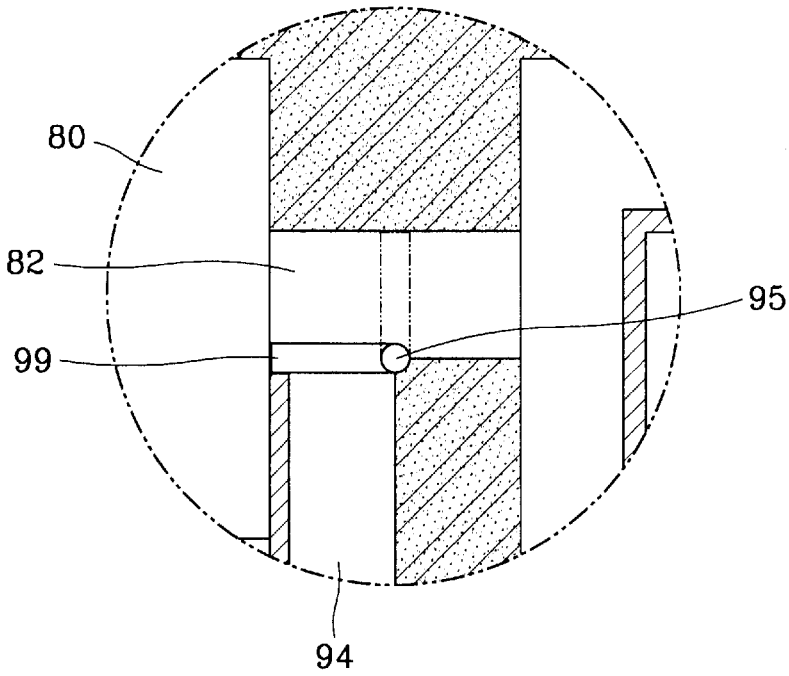
FIG. 14 is a partial sectional view illustrating an operation state of a valve plate of the device for controlling the cooling air supply of the refrigerator in accordance with the third embodiment of the present invention.

FIG. 13 is a block diagram illustrating the cooling air control means in accordance with the third embodiment of the present invention.

The cooling air control means is constructed with a freezing chamber discharge duct 94 connected between the cooling air supply path 82 and the freezing chamber 4 and discharging the cooling air supplied from the cooling air supply path 82 to the freezing chamber 4, an opening/closing means closing one of a flow path for supplying the cooling air to the chilling chamber 6 and a flow path for supplying the cooling air to the cooling air discharge duct 94, a temperature sensor 96 installed to the chilling chamber 6 and sensing a temperature of the chilling chamber 6, and a control unit 98 operating the opening/closing means in accordance with an electric signal applied from the temperature sensor 96.

The freezing chamber discharge duct 94 formed at the side wall of the freezing chamber 4 besides the discharge duct discharging the cooling air from the cooling chamber 80 to the freezing chamber 4 is interconnected with the cooling air supply path 82 and has a plurality of cooling air discharge holes 97 discharging the cooling air to the freezing chamber 4.

As depicted in FIG. 13, the opening/closing means is constructed with a valve plate 99 having a flat plate shape rotatively installed to a point at which the cooling air supply path 82 and the freezing chamber discharge duct 94 are connected, and a stepping motor 95 connected to the rotational axis of the valve plate 99 and rotating the valve plate 99.

In supply of the cooling air to the chilling chamber 6, as depicted in FIG. 11, the valve plate 99 closes the freezing chamber discharge duct 94, the cooling air is supplied to the chilling chamber 6 through the cooling air supply path 82, in supply of the cooling air to the freezing chamber 4, as depicted in FIG. 12, the valve plate 99 closes the cooling air supply path 82, the cooling air is supplied to the chilling chamber 6 through the freezing chamber discharge duct 94.

Any sensor sensible a temperature inside the chilling chamber 6 and appliable an electric signal to the control unit 98 can be used as the temperature sensor 96.

The operation of the device for controlling the cooling air supply of the refrigerator in accordance with the third embodiment of the present invention will be described.

The cooling air discharged from the cooling chamber 80 to the freezing chamber 4 performs the cooling operation of the freezing chamber 4, is supplied to the chilling chamber 6 through the cooling air supply path 82 and performs the cooling operation of the chilling chamber 6.

Herein, as depicted in FIG. 11, the valve plate 99 is operated in a direction closing the freezing chamber discharge duct 94 and opening the cooling air supply path 82. Then, the cooling air flows into the cooling air ducts 84, 86 through the cooling air supply path 82, is discharged through the plurality of discharge holes 88, 90, 92 formed at the rear, left and right sides of the chilling chamber 6, accordingly the cooling operation of the chilling chamber 6 can be performed.

Herein, when the temperature sensor 96 installed inside the chilling chamber 6 senses a temperature inside the chilling chamber 6 and applies an electric signal to the control unit 98, the control unit 98 compares the electric signal applied form the temperature sensor 96 with a set value, when the signal value applied from the temperature sensor 96 reaches the set valve, the control unit 98 operates the valve plate 99.

Then, the valve plate 99 is operated in a direction at which the cooling air supply path 82 is closed and the freezing chamber discharge duct 94 is opened, accordingly the flow path is switched so as to supply the cooling air to the freezing chamber 4.

As described above, when the temperature inside the chilling chamber 6 reaches the set temperature, the rest of the cooling air to be discharged into the chilling chamber 6 is discharged into the freezing chamber 4, accordingly an efficiency of the whole refrigerator can be improved.

Effects of the device for controlling the cooling air supply of the refrigerator in accordance with the embodiments of the present invention will be described.

When a temperature at a certain partition inside a chilling chamber rises due to lots of preserved foods, etc, cooling air is intensively discharged to the partition, accordingly a temperature inside the whole chilling chamber can be regular in a short time.

In addition, a temperature at the left side or the right side of a chilling chamber rises, cooling air is intensively discharged to a cooling air duct placed at the temperature rising side, accordingly a temperature inside the while chilling chamber can be regular in a short time.

In addition, when a temperature inside a chilling chamber rises due to lots of preserved foods or opening/closing of a door, etc., it is possible to coping with the temperature rise of a refrigerator by instantly supplying lots of cooling air by applying a discharge pressure to the cooling air discharged into the chilling chamber.

In addition, when a temperature inside a chilling chamber reaches an optimum value, cooling air is supplied to a freezing chamber by varying a flow path of the cooling air to be supplied to the chilling chamber, accordingly an efficiency of a refrigerator can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A device for controlling a cooling air supply of a refrigerator, comprising:

a cooling air supply path formed at the upper portion of a mullion wall demarcating a chilling chamber and a freezing chamber and supplying cooling air ventilated by a ventilation fan to the chilling chamber;

a cooling air guide path diverged from the cooling air supply path and guiding the cooling air to each part of the chilling chamber;

a left cooling air duct diverged from the cooling air guide path in the left direction and discharging the cooling air to the left side of the refrigerating chamber;

a right cooling air duct diverged from the cooling air guide path in the right direction and discharging the cooling air to the right side of the refrigerating chamber; and a cooling air control means selectively discharging the cooling air through the left cooling air duct and the right cooling air duct in accordance with a position at which a load has occurred.

2. The device of claim 1, wherein the cooling control means includes:

a left temperature sensor respectively installed to the left wall surface of the chilling chamber and sensing a temperature at the left side of the chilling chamber;

a right temperature sensor installed to the right wall surface of the chilling chamber and sensing a temperature at the right side of the chilling chamber;

an opening/closing means selectively connecting a flow path between the cooling air supply path and the left/right cooling air guide ducts; and a control unit operating the opening/closing means in accordance with an electric signal applied from the left temperature sensor and the right temperature sensor.

3. The device of claim 2, wherein the opening/closing means includes:

a valve plate rotatively installed at a turning point between the cooling air supply path and the cooling air guide path; and a stepping motor connected to the rotational axis of the valve plate and adjusting a rotational angle of the valve plate.

4. The device of claim 3, wherein the valve plate rotatively installed to the diverged centrical portion of the cooling air supply path is formed as a disk shape respectively operated as a neutral position regularly supplying a cooling air to the left and the right cooling air guide paths, a left closing position closing the left cooling air guide path and a right closing position closing the right cooling air guide path.

5. A device for controlling a cooling air supply of a refrigerator, comprising:

a cooling air supply path formed at the upper portion of a mullion wall demarcating a chilling chamber and a freezing chamber and supplying cooling air ventilated by a ventilation fan to the chilling chamber;

a cooling air guide path diverged from the cooling air supply path and guiding the cooling air to each part of the chilling chamber;

a cooling air duct connected to the cooling air guide path and discharging the cooling air to each partition demarcated by shelves of the chilling chamber; and a cooling air control means intensively discharging the cooling air to a partition at which a load has occurred of the partitions demarcated by the shelves of the chilling chamber.

6. The device of claim 5, wherein the cooling control means includes:

a temperature sensing means respectively installed to each partition demarcated by the selves of the chilling chamber;

an opening/closing means respectively formed at each of a plurality of cooling air discharge holes formed at each partition of the chilling chamber and performing an opening/closing operation of each of the plurality of cooling air discharge holes; and a control unit operating the opening/closing means selectively according to an electric signal applied from the temperature sensing means.

7. The device of claim 6, wherein the temperature sensing means is constructed with a plurality of temperature sensors respectively installed to each partition demarcated by the shelves of the chilling chamber, detecting a temperature of each partition and applying it to the control unit.

8. The device of claim 6, wherein the opening/closing means includes:

a valve plate rotatively installed to each cooling discharge hole and performing an opening/closing operation of the cooling air discharge hole; and a stepping motor connected to a rotational axis of the valve plate and rotating the valve plate according to the electric signal applied to the control unit.

9. The device of claim 8, wherein the valve plate is formed as a flat plate shape.

10. A device for controlling a cooling air supply of a refrigerator, comprising:

a cooling air supply path formed at the upper portion of a mullion wall demarcating a chilling chamber and a freezing chamber and supplying cooling air ventilated by a ventilation fan to the chilling chamber;

a cooling air guide path diverged from the cooling air supply path and guiding the cooling air to each part of the chilling chamber;

a cooling air duct connected to the cooling air guide path and discharging the cooling air to each partition diverged by shelves of the chilling chamber; and a ventilation means installed to the side of the cooling air supply path, applying a ventilation pressure to the cooling air supplied to the chilling chamber and performing an opening/closing operation of the cooling air supply path.

11. The device of claim 10, wherein the ventilation means is constructed as a blower installed to a position at which the cooling air guide path is diverged from the cooling air supply path, closing the cooling air supply path when a temperature inside the chilling chamber reaches a set value and applying a ventilation pressure to the cooling air.

12. A device for controlling a cooling air supply of a refrigerator, comprising:

a cooling air supply path formed at the upper portion of a mullion wall demarcating a chilling chamber and a freezing chamber and supplying cooling air ventilated by a ventilation fan to the chilling chamber;

a cooling air guide path diverged from the cooling air supply path and guiding the cooling air to each part of the chilling chamber;

a cooling air duct connected to the cooling air guide path and discharging the cooling air to each partition demarcated by shelves of the chilling chamber;

a blower installed to the side of the cooling air supply path and applying a ventilation pressure to the cooling air supplied to the chilling chamber; and a cooling air control means discharging the cooling air intensively to a partition at which a load has occurred of the partitions demarcated by the shelves of the chilling chamber.

13. A device for controlling a cooling air supply of a refrigerator, comprising:

a cooling chamber formed at the upper portion of a chilling chamber and respectively supplying cooling air to a freezing chamber and the chilling chamber;

a cooling air supply path formed at the upper portion of a mullion wall demarcating the freezing chamber and the chilling chamber and supplying the cooling air from the cooling chamber to the chilling chamber;

a cooling air duct discharging the cooling air supplied to the cooling air supply path to the chilling chamber; and a cooling air control means switching a cooling air flow path in order to supply the cooling air supplied to the chilling chamber to the freezing chamber when a temperature of the chilling chamber reaches a set temperature.

14. The device of claim 13, wherein the cooling air control means includes:

a freezing chamber discharge duct connected between the cooling air supply path and the freezing chamber and discharging the cooling air supplied from the cooling air supply path to the freezing chamber;

an opening/closing means installed to the side of the cooling air supply path and closing one of the cooling air supply path and the freezing chamber discharge duct;

a temperature sensor installed to the chilling chamber and sensing a temperature of the chilling chamber; and a control unit operating the opening/closing means in accordance with an electric signal applied from the temperature sensor.

15. The device of claim 14, wherein the freezing chamber discharge duct is formed at the side surface of the freezing chamber, interconnected with the cooling air supply duct and includes a plurality of cooling air discharge holes discharging the cooling air to the freezing chamber.

16. The device of claim 14, wherein the opening/closing means includes:

a valve plate rotatively installed at a turning point between the cooling air supply path and the cooling air guide path and selectively closing one of the cooling air supply path and the cooling air guide path; and a stepping motor connected to the rotational axis of the valve plate and rotating the valve plate.

17. The device of claim 16, wherein the valve plate is formed as a disk shape facilitative for closing the cooling air supply path and the cooling air guide path.

* * * * *